United States Patent [19]

Bialy et al.

[11] 3,976,441

[45] Aug. 24, 1976

[54] SUBSTITUTED AMINOALKYLPROPANEDIOL AND MOTOR FUEL COMPOSITION CONTAINING SAME

[75] Inventors: Jerzy J. Bialy, Lagrangeville; David G. Weetman, Hopewell Junction, both of N.Y.

[73] Assignee: Texaco Inc., New York, N.Y.

[22] Filed: Sept. 25, 1975

[21] Appl. No.: 616,700

[52] U.S. Cl. ..... 44/72; 252/392

[51] Int. Cl.[2] ..... C10L 1/22

[58] Field of Search ..... 44/72; 252/392; 21/2.5 R

[56] References Cited

UNITED STATES PATENTS

| | | | |
|---|---|---|---|
| 2,872,303 | 2/1959 | Donlan | 44/72 |
| 3,201,349 | 8/1965 | Quanstrom | 252/392 |
| 3,240,578 | 3/1966 | Eckert | 44/72 |
| 3,372,009 | 3/1968 | Waldmann | 44/72 |

*Primary Examiner*—Daniel E. Wyman
*Assistant Examiner*—Y. Harris-Smith
*Attorney, Agent, or Firm*—T. H. Whaley; C. G. Ries; James J. O'Loughlin

[57] ABSTRACT

Substituted aminoalkylpropanediol represented by the formula:

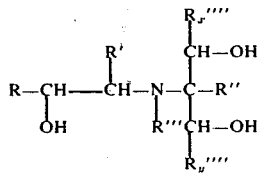

in which R is a hydrocarbon radical having from 1 to 24 carbon atoms, R′, R″, R‴ and R⁗ represent hydrogen or a hydrocarbon radical having from 1 to 10 carbon atoms, and *x* and *y* are integers from 1 to 10, and a motor fuel composition containing same.

10 Claims, No Drawings

SUBSTITUTED AMINOALKYLPROPANEDIOL AND MOTOR FUEL COMPOSITION CONTAINING SAME

BACKGROUND OF THE INVENTION

1. Field of the Invention

Modern gasoline compositions are very highly refined products. Despite this, they contain minor amounts of impurities which tend to promote corrosion during the time that the bulk fuel is being transported or maintained in storage and also during the residence time in the fuel tank, fuel lines and carburetor of a motor vehicle. A commercial motor fuel composition must contain a corrosion inhibiting additive or additive combination to inhibit or prevent corrosion during the transport and storage of the bulk fuel and during its residence time in the fuel system of the motor vehicle. Another requirement of the corrosion inhibitor is that it in no way diminish the effectiveness of the other essential additivies of the fuel composition.

2. Description of the Prior Art

A pending application Ser. No. 533,909 filed Dec. 18, 1974, now U.S. Pat. No. 3,926,578 discloses a hydrocarbylamine substituted propionic ester and its use as a carburetor detergent and rust inhibitor in a motor fuel composition.

SUMMARY OF THE INVENTION

A class of substituted aminoalkyl propanediols has been discovered which is effective as a rust or corrosion inhibitor when employed in a liquid hydrocarbon fuel composition. The prescribed compounds, appear to be unique in their effectiveness as rust inhibitors at very low concentrations. The additives are also characterized by exhibiting low extractability from gasoline in the presence of tank water bottoms.

DESCRIPTION OF THE PREFERRED EMBODIMENTS

The substituted aminoalkyl-propanediol of the invention is represented by the formula:

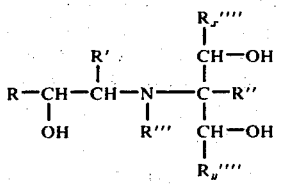

in which R is a hydrocarbon radical having from 1 to 24 carbon atoms, R′, R″, R‴ and R⁗ represent hydrogen or a hydrocarbon radical having from 1 to 10 carbon atoms, and $x$ and $y$ are integers from 1 to 10.

The novel motor fuel composition of the invention comprises an effective rust inhibiting amount of the above described substituted aminoalkylpropanediol.

The preferred group of substituted aminoalkylpropanediol is represented by the formula:

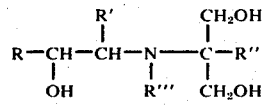

in which R is a hydrocarbon radical having from about 6 to 16 carbon atoms and R′, and R‴ are hydrogen and R″ is a hydrocarbon radical having from 1 to 4 carbon atoms.

The prescribed substituted aminoalkylpropanediol of the invention is readily prepared by reacting an alpha olefin epoxide with a 2-amino-2-alkyl-1,3-propanediol. The reaction is conducted by reacting approximately one mole of the alpha olefin epoxide with one mole of a 2-amino-2-alkyl-1,3-propanediol. This invention contemplates the use of higher and lower mole ratios of the diol in this reaction with the resultant reaction product comprising a mixture containing in addition to the principal product some other closely related products, such as the product derived from the reaction of the amine with greater than 1 mole of epoxide. It is contemplated that such a mixture can be beneficially employed in the fuel composition of the invention.

In general, the reaction proceeds in accordance with the following formula wherein the symbols have the values noted above:

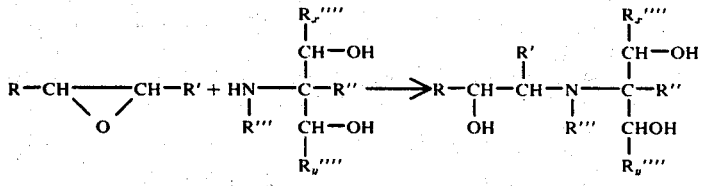

The alpha olefin reactant which can be employed is a straight chain aliphatic hydrocarbon having from about 1 to 24 and preferably 8 to 18 carbon atoms characterized by having an alpha olefin epoxide functional group at one end of the chain. These materials are available commercially generally as mixtures of alpha olefin epoxides. The mixture consisting of $C_{11}$–$C_{14}$ alpha olefin epoxides and of $C_{15}$–$C_{18}$ alpha olefin epoxides are typical of the reactants employed. This invention contemplates, however, the use of both alkyl and aryl epoxides as well as mixtures of substituted alkyl and substituted aryl derived epoxides. A list of suitable epoxides for this reaction is set forth in Table I below:

TABLE I 1,2-epoxyoctane
1,2-epoxybutane
1,2-epoxyhexane
1,2-epoxydodecane
1,2-epoxytetradecane
1,2-epoxyhexadecane
1,2-epoxyoctadecane
1,2-epoxydecane
epoxystyrene
alkylepoxystyrene The amino alkylpropanediol reactant employed for preparing the prescribed rust inhibitor of the invention can be a single compound or a mixture of compounds corresponding to the formula set forth above. Examples of suitable amino alkyl propane diol reactants are illustrated in Table II below.

TABLE II 2-amino-2-methyl-1,3-propanediol
2-amino-2-ethyl-1,3-propanediol
2-amino-2-propyl-1,3-propanediol
2-amino-2-butyl-1,3-propanediol
2-amino-2-decyl-1,3-propanediol
2-amino-2-octyl-1,3-propanediol
2-amino-2-isopropyl-1,3-propanediol The reactants are brought together in a reaction vessel and gradually heated until the reaction commences which will generally be in the range of 110°–130°C. In or about this temperature range an exothermic reaction begins which causes the temperatures of the reagents to inrease to 150°–180°C. The resulting product mixture is retained within or about this temperature range for 0.1–0.5 hour and than allowed to cool to room temperature.

The following examples illustrate the preparation of specific materials employed in the present invention.

EXAMPLE I

240 Grams (2.0 moles) of 2-amino-2-ethyl-1,3-propanediol and 410 grams (2.1 moles) of a $C_{11}$–$C_{14}$ alpha olefin epoxide mixture were charged to a reaction vessel. The stirred mixture was gradually heated to 120°–140°C within which range range an exothermic reaction occurred. The temperature increased to 174°–180°C. The product mixture remained within this temperature range for 0.5 hours and was then allowed to cool to room temperature. The material was subjected to a vacuum distillation to remove volatiles yielding a residue was 596 grams of product.

EXAMPLE II

303 Grams (2.89 moles) 2-amino-2-methyl-1,3-propanediol and 590 grams (3.02 moles) of a $C_{11}$–$C_{14}$ straight chain alpha olefin epoxide were charged to a reaction vessel, reacted and recovered as described in Example I. 816 Grams of product were realized.

Specific 2-(2-hydroxy $C_8$–$C_{18}$ alkylamino)-2-alkyl-1,3-propanediols within the scope fo this invention include:

2-(2-hydroxyoctylamine)-2-methyl-1,3-propanediol
2-(2-hydroxyoctylamine)-2-ethyl-1,3-propanediol
2-(2-hydroxy $C_{11}$–$C_{14}$ alkylamino)-2-methyl-1,3-propanediol
2-(2-hydroxy $C_{11}$–$C_{14}$ alkylamino)-2-ethyl-1,3-propanediol
2-(2-hydroxy $C_{11}$–$C_{14}$ alkylamino)-2-propyl-1,3-propanediol
2-(2-hydroxy $C_{15}$–$C_{18}$ alkylamino)-2-methyl-1,3-propanediol
2-(2-hydroxy $C_{15}$–$C_{18}$ alkylamino-2-ethyl-1,3-propanediol The base fuel employed for preparing the motor fuel composition of the invention comprises a mixture of hydrocarbons boiling in the gasoline boiling range. This base fuel may consist of straight chain or branched chain paraffins, cycloparaffins, olefins, or aromatic hydrocarbons or any mixture of these. The base fuel can be derived from straight run naphtha, polymer gasoline, natural gasoline or from catalytically cracked or thermally cracked hydrocarbons and catalytically reformed stocks.

The composition of hydrocarbon components of the base fuel is not critical nor does the octane level of the base fuel have any material effect on the invention. In general, the base fuel will boil in a range from about 80° to about 450°F.

The fuel composition may contain any of the additives normally employed in gasoline. Thus, the fuel composition can contain an anti-knock compound such as tertraalkyl lead compound, including tetraethyllead, tetramethyllead, tetrabuyllead and mixtures thereof. The fuel composition can also contain anti-icing additives, dyes, upper cylinder lubricating oils and the like.

The prescribed substituted aminoalkylpropanediol of the invention is employed in a gasoline motor fuel composition at a concentration effective to provide or to enhance the corrosion inhibiting properties of the fuel composition. In general, an effective concentration of the additive ranges from about 0.0001 to 0.01 weight percent with a preferred concentration ranging from about 0.00025 to 0.005 weight percent. The limits of the preferred range correspond respectively to about 1.25 and 25 PTB (pounds of additive per 1000 barrels of gasoline).

The prescribed substituted aminoalkylpropanediol additive of the invention was tested for its corrosion inhibiting properties in gasoline in the Colonial Pipeline Rust Test described below:

COLONIAL PIPELINE RUST TEST

A steel spindle, 3 3/16 inches long and ½ inch wide, made from ASTM D-665-60 steel polished with Crystal Bay fine emery paper, is used in the Colonial Pipeline Rust Test. The spindle is placed in a 400cc beaker with 300cc of fuel sample, which is maintained at 100°F. for one-half hour. Then 30cc of distilled water is added. The beaker and contents are kept at 100°F. for 3½ hours. The spindle thereafter visually inspected and the percent of rusted surface ares is estimated. An average rust result of less than 5 percent rust is a passing value in this Rust Test.

The Base Fuel employed in the following examples was a premium grade gasoline having a Research Octane Number of about 92 containing 0 cc. of tetraethyl lead per gallon. This gasoline consisted of about 10 percent olefinic hydrocarbons and 65 percent paraffinic hydrocarbons and boiled in the range from about 90° to 360°F.

The Base Fuel was blended with known gasoline additives to form a Base Blend consisting of the Base Fuel and about 0.194 volume percent of an additive mixture which imparted acceptable levels of carburetor detergency, intake valve deposits modification, and anti-icing properties. This Base Blend was unsuitable as a commercial gasoline or finished fuel composition because it exhibited an unacceptable degree of rusting in the Colonial Pipeline Rust Test. The anti-rust properties of the novel fuel composition of the invention are shown in the table below.

TABLE

COLONIAL PIPELINE RUST TEST

| Run | Fuel Composition | Additive & Conc. | Rust Rating |
|---|---|---|---|
| 1. | Base Blend | none | Fail (5–10) |
| 2. | Base Blend | 8 PTB of Example I | Pass (Trace) |
| 3. | Base Blend | 4 PTB of Example I | Pass (Trace) |
| 4. | Base Blend | 3 PTB of Example I | Pass (Trace) |

TABLE-continued

| COLONIAL PIPELINE RUST TEST | | | |
|---|---|---|---|
| Run | Fuel Composition | Additive & Conc. | Rust Rating |
| 5. | Base Blend | 5 PTB of Example II | Pass (Trace) |
| 6. | Base Blend | 4 PTB of Example II | Pass (Trace) |

1) PTB = Pound of Additive per 1000 barrels of gasoline

The foregoing tests show that the additive of the invention was most effective for enhancing the corrosion inhibiting properties of the gasoline fuel composition as determined in the Colonial Pipeline Rust Test thus providing a commercially acceptable fuel composition.

The additive of the invention was also tested for its resistance to extractability in the presence of tank water bottoms. The water employed in the tests was buffered to pH 5 to represent an acid water bottom environment and to pH 12 to represent a caustic water bottom environment. Under both conditions, the fuel composition of the invention resisted water extraction as compared to the Base Blend described above. The fuel composition continued to pass the Colonial Pipeline Rust Test after the attempted water extraction test while a commercial gasoline composition which initially passed the Colonial Pipeline Rust Test failed the Rust Test following both acid and caustic water extraction.

We claim:

1. A motor fuel composition comprising a mixture of hydrocarbons in the gasoline boiling range containing from about 0.0001 to 0.01 weight percent of a substituted aminoalkylpropanediol represented by the formula:

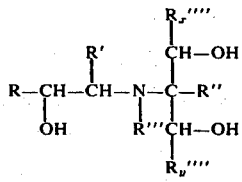

in which R is a hydrocarbon radical having from 1 to 24 carbon atoms, R′, R″, R‴ and R⁗ represent hydrogen or a hydrocarbon radical having from 1 to 10 carbon atom and $x$ and $y$ are integers from 1 to 10.

2. A motor fuel composition comprising a mixture of hydrocarbons in the gasoline boiling range containing from about 0.0001 to 0.01 weight percent of a substituted aminoalkylpropanediol represented by the formula:

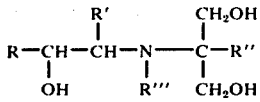

in which R is a hydrocarbon radical having from about 6 to 16 carbon atoms, R′ and R‴ are hydrogen and R″ is a hydrocarbon radical having from 1 to 4 carbon atoms.

3. A motor fuel composition according to claim 2 in which R″ is a methyl radical.

4. A motor fuel composition according to claim 2 in which R″ is an ethyl radical.

5. A motor fuel composition according to claim 1 in which said substituted aminoalkylpropanediol is 2-(2-hydroxyoctylamine)-2-methyl-1,3-propanediol.

6. A motor fuel composition according to claim 1 in which said substituted aminoalkylpropanediol is 2-(2-hydroxyoctylamine)-2-ethyl,-3-propanediol.

7. A motor fuel composition according to claim 1 in which said substituted aminoalkylpropanediol is 2-(2-hydroxy $C_{11}$–$C_{14}$ alkylamino)-2-methyl-1,3-propanediol.

8. A motor fuel composition according to claim 1 in which said substituted aminoalkylpropanediol is 2-(2-hydroxy $C_{15}$–$C_{18}$ alkylamino)-2-methyl-1,3-propanediol.

9. A motor fuel composition according to claim 1 containing from about 0.0001 to 0.005 weight percent of said substituted aminoalkylpropanediol.

10. A motor fuel composition according to claim 1 in which said substituted aminoalkylpropanediol is represented by the formula:

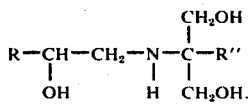

* * * * *